United States Patent [19]

Doyle

[11] 4,262,570

[45] Apr. 21, 1981

[54] HOSE CUTTER

[75] Inventor: Melvin J. Doyle, Plymouth, Minn.

[73] Assignee: Marvel Rack Manufacturing Co., Minneapolis, Minn.

[21] Appl. No.: 111,106

[22] Filed: Jan. 10, 1980

[51] Int. Cl.[3] ..... B26D 3/16

[52] U.S. Cl. ..... 83/397; 83/553; 83/580; 83/607

[58] Field of Search ..... 83/397, 553, 580, 605–609

[56] References Cited

U.S. PATENT DOCUMENTS 2,263,466 11/1941 McCarthy ..... 83/397

*Primary Examiner*—J. M. Meister

*Attorney, Agent, or Firm*—Merchant, Gould, Smith, Edell, Welter & Schmidt

[57] ABSTRACT

A hose cutter (10) is disclosed comprising a rotatable blade mechanism (20) anchored at one of a plurality of anchor stations to vertically-oriented, spaced-apart support plates (12, 14) having corresponding hose support openings (96, 98, 100, 102, 104) cut therein. Rotatable blade mechanism (20) is translatable in corresponding U-shaped slots between anchor stations. At a particular anchor station (A or B), a rotatable anchor arm (22 or 24) locks the pivoted fastening joint (38) of rotatable blade mechanism (20) into the relevant set of vertical legs of the corresponding U-shaped slots. With a hose inserted into one set of the corresponding support openings, the blade mechanism (20) may be rotated to cut the hose.

9 Claims, 7 Drawing Figures

A

HOSE CUTTER

FIELD OF THE INVENTION

This invention relates to a hose cutter, and, more particularly, to an apparatus having a single cutting mechanism movable among a plurality of anchoring stations in order to cut hoses of different diameters.

BACKGROUND OF THE INVENTION

Hose cutting apparatus have been known for some time. These previous mechanisms generally supported a hose while a blade was cuttingly moved through the hose. One such machine had spaced-apart, parallel support plates with lateral, semi-circular slots formed in the top thereof. A blade was attached to the support plates in such a way that the blade pressed down from the top and cut the hose while the hose was being supported in the slot. As the blade cut through the hose, it passed between the spaced-apart plates.

Another such machine was constructed similarly, except instead of lateral slots it had openings passing laterally through the support plates. With a hose inserted into one of the openings for support, a blade pressed from the top and moved cuttingly through the hose and between the support plates.

Among other reasons, the prior art hose cutters were limited in use since, in each, a blade was anchored at a single station thereby allowing a particular device to cut only a small number of different diameter hoses.

SUMMARY OF THE INVENTION

The present invention is comprised of a blade, means for supporting a hose while the blade is cuttingly moved through the hose, means attached to the blade for moving the blade with respect to the hose support means, and means for anchoring the blade moving means to the hose support means at a plurality of anchoring stations. Additionally, the anchoring means allows translation of the blade moving means from one station to another.

In a preferred embodiment, angle members, which may be attached to a horizontal bench surface, are attached on the outer sides of two vertically-oriented, spaced-apart support plates. A blade with a handle and yieldable blade guard plates are pivotally attached at an off-center point to the support plates. The blade may be translated at its pivotal attachment point through corresponding U-shaped slots in the support plates to one of two anchoring stations. An anchoring mechanism, comprised of a rotatable arm having a step-shaped notch for engagement with the blade pivot, is located approximately beneath each vertical leg of the U-shaped slots. One of the anchoring mechanisms can lock the blade pivot in one set of vertical legs of the corresponding U-shaped slots, while the other anchoring mechanism can lock the blade pivot in the other set of vertical legs of the corresponding U-shaped slots. At each anchor station, the support plates have appropriately-located, circular openings of different diameters for supporting hoses of slightly smaller diameters.

To operate, the hose to be cut is inserted in one set of circular openings having diameter slightly larger than the hose. The pivotal attachment point for the blade is locked with the anchoring mechanism at the anchor station appropriate for the circular openings being used. The handle on the blade is rotated clockwise to cut the hose. For hoses of different diameters, different diameter openings and a second anchor station are available.

The present invention is particularly advantageous in that a relatively small blade is used in the same cutting apparatus to cut hoses of particular diameters at one anchoring station and hoses of entirely different diameters at another anchoring station. Although versatile in this manner, the apparatus is relatively small, inexpensive and highly reliable due to its small number of moving parts.

Furthermore, since the present invention uses circular openings for hose support, rather than semi-circular slots cut in the top of a support means, it is especially useful to cut the ends of a hose.

For a still better understanding of the invention, its advantages, and objects attained by its use, reference should be had to the drawings which form a further part hereof, and to the accompanying descriptive matter, in which there are illustrated and described preferred and other embodiments of the invention.

DESCRIPTION OF THE PREFERRED EMBODIMENT

Figures 1, 2, 7:
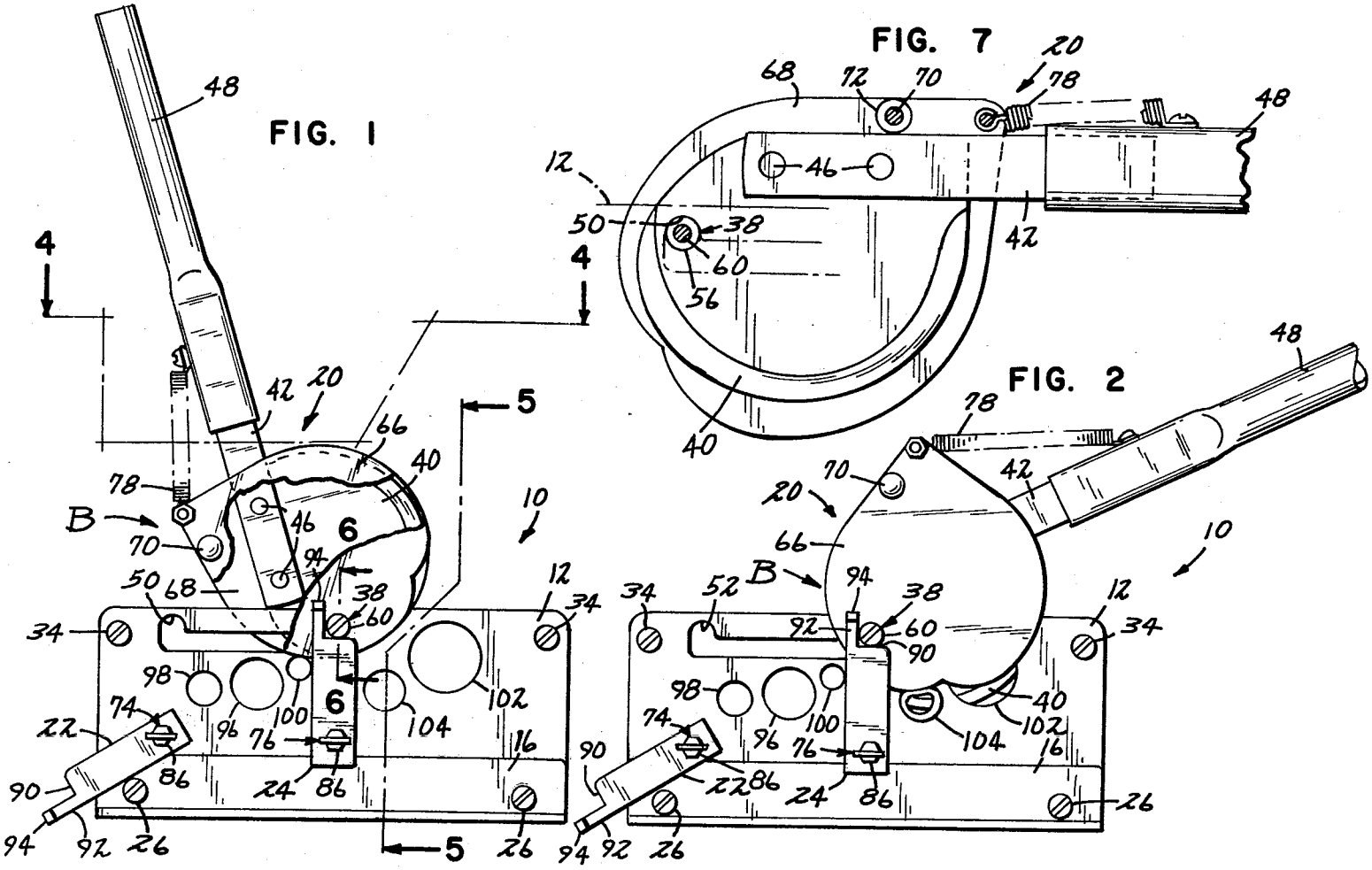
FIG. 1 is a side view of the invention showing the blade and handle in a position which allows insertion of a hose into the appropriate corresponding openings of the support plates.
FIG. 2 is similar to FIG. 1 except the blade is shown in a position where it has partially cut a supported hose.
FIG. 7 is a side view of the blade and attached handle with the nearer-most guard plate removed.

Referring now to the drawings wherein like reference numerals designate identical or corresponding parts throughout the several views, and more particularly to FIG. 1, the present invention, a hose cutter, is designated generally as 10.

In a preferred embodiment, hose cutter 10 is comprised of support plates 12, 14, which in turn are supported by angles 16, 18. A rotatable blade mechanism 20 is fixed to support plates 12, 14 at one of two stations by one of two rotatable anchor arms 22, 24. More generally, it is to be understood that, although the preferred embodiment is herein described as having two anchor stations, hose cutting apparatus in accordance with the invention could have more than two such stations. Similarly, although plates are hereinafter described as means for supporting a hose to be cut, a block or some other shape of material could be fashioned in accordance with the invention to perform the hose support function.

Figures 3, 4, 5, 6:
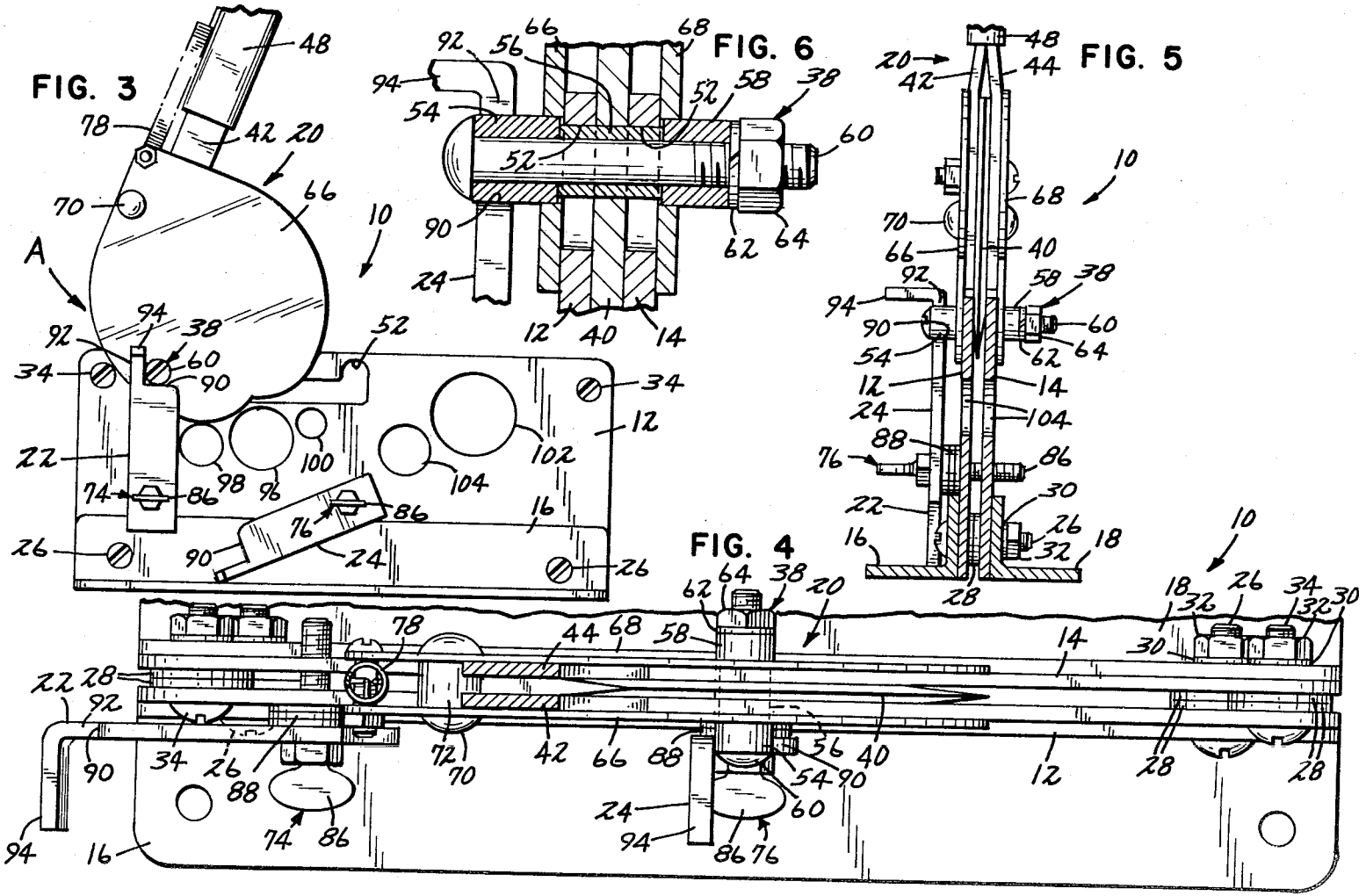
FIG. 3 is similar to FIG. 1 except the blade is anchored at a different station from that shown in FIG. 1.
FIG. 4 is a partially cut-away, top view of the invention, taken along line 4—4 of FIG. 1.
FIG. 5 is a partially cut-away, front view of the invention, taken along line 5—5 of FIG. 1.
FIG. 6 is a cross-sectional view of the pivotal attachment of the blade as anchored to the support plates taken along line 6—6 of FIG. 1.

Identical support plates 12, 14 are substantially rectangular in shape with corresponding U-shaped slots and circular openings, to be hereinafter described, extending therethrough. Plates 12, 14 are fastened together in a spaced-apart, approximately parallel relationship with all corresponding sides approximately flush. Separate spacers 28 (see FIG. 4), encircled about screws 26 and screws 34, ensure a spacing between plates 12 and 14 slightly greater than the width of blade 40 of rotatable blade mechanism 20. Angles 16, 18 are fastened adjacent one of the longer sides of plates 12, 14, respectively. The angles 16, 18 provide a flat base from which to support the vertically-held support plates 12, 14. Angle 16 is fastened such that the vertical portion of angle 16 is in parallel contact with support plate 12 and the horizontal portion of angle 16 extends away from support plate 12. Angle 18 has a similar relationship with support plate 14, except angle 18 is located on the side opposite support plates 12, 14 as angle 16, and the horizontal portion of angle 18 extends in a direction opposite the horizontal portion of angle 16. As shown in FIGS. 1 and 4, screws 26 pass through corresponding openings near the ends of the vertical portions of angles 16, 18 and through corresponding openings in the lower corners of support plates 12, 14. More particularly, a screw 26 passes through an appropriately sized opening in angle 16, support plate 12, spacer 28, support plate 14 and angle 18, respectively, and is fastened in place with washer 30 and nut 32. Somewhat similarly, in each upper corner of support plates 12, 14, a screw 34 passes through an appropriately-sized opening in support plate 12, spacer 28, and support plate 14, respectively, and is fastened with a washer 30 and nut 32.

As indicated, corresponding U-shaped slots extend through support plates 12 and 14. A fastening joint 38, to be described hereinafter, has elements which pass through the U-shaped slots to pivotally fasten rotatable blade mechanism 20 to support plates 12 and 14.

Blade 40, a vital element of rotatable blade mechanism 20, has an unsharpened, flat upper edge. As shown in FIG. 7, the periphery of blade 40 extends from the unsharpened, flat upper edge forwardly and downwardly in an arcuate manner to blend with a substantially semicircular lower blade portion which in turn blends with a tangential vertical forming a right angle at the opposite end of the unsharpened flat upper blade. Blade 40 is ground on both its sides to a sharp edge along approximately the semicircular portion of its periphery.

Identical links 42, 44 (see FIGS. 5 and 7) are attached with rivets 46, or an equivalent fastening device, to blade 40. Links 42, 44 are elongated plates having an end located approximately at the end of the flat upper edge of blade 40 opposite the right angle end of the flat upper edge of blade 40 and an upper edge of links 42, 44 located approximately flush with the flat upper edge of blade 40. Links 42, 44 extend along the flat edge of blade 40 in a spaced-apart relationship. At approximately the midpoint, links 42, 44 have a slight s-shaped bend which allows the second end portions of links 42, 44 to be in contact with one another rather than in the spaced-apart relationship. Tubular handle 48 has one end portion somewhat flattened to fit snugly about the second end portions of links 42, 44. In addition to the friction fit of handle 48 to links 42, 44, a weld or other equivalent fastening mechanism may be used to ensure the attachment of handle 48.

As indicated previously, fastening joint 38 slides within the corresponding U-shaped slots of support plates 12, 14. The U-shaped slots are located (see FIGS. 1 and 3) such that the semi-circular, upper edges 50, 52 of the corresponding sets of vertical legs are near the upper edges of support plates 12, 14 leaving only sufficient thickness between edges 50, 52 and the upper edges of the support plates 12, 14 to provide structural strength to prevent the portion of support plates 12, 14 between the vertical legs of the U-shaped slots from breaking away. From side to side, U-shaped slots are located such that the set of corresponding vertical legs nearest the left vertical edge of support plates 12, 14 as viewed from the outer side of support plate 12 is approximately an inch from those corresponding edges. The other set of corresponding vertical legs is approximately midway between the vertical edges of support plates 12, 14.

With anchor arm 22 holding fastening joint 38 against edges 50 of the U-shaped slots and with blade 40 between support plates 12, 14 such that attached handle 48 is horizontal, as indicated in FIG. 7, the axis of fastening joint 38 passes through blade 40 near its peripheral edge opposite handle 48. As shown in FIG. 6, fastening joint 38 is comprised of spacers 54, 56 and 58 which encircle screw 60 which in turn is held in place by washer 62 and nut 64. Spacer 56 has an outer diameter slightly smaller than the opening through which it passes in blade 40, allowing blade 40 to freely rotate about spacer 56. Spacer 56 has length slightly greater than the distance between the outer edges of support plates 12, 14. One end of spacer 54 contacts an end of spacer 56 and the outer side of support plate 12, and one end of the spacer 58 contacts the opposite end of spacer 56 and the outer side of support plate 14. The U-shaped slots in support plates 12, 14 have a width slightly greater than the diameter of spacer 56. Spacers 54 and 58 have equivalent outer diameters which are greater than the width of the U-shaped slots. Spacer 54 has length sufficient to extend from the outer surface of support plate 12 through guard plate 66 to slightly beyond a plane in which the outer surfaces of both anchor arms 22 and 24 lie. Spacer 58 has sufficient length to extend from the outer surface of support plate 14 for a distance of approximately three thicknesses of guard plate 68.

As shown in FIG. 7, identical guard plates 66, 68 are fastened together with rivet 70, or other equivalent fastening means, and held in a spaced-apart relationship with spacer 72 which encircles rivet 70. Spacer 72 has sufficient length to allow the inner surfaces of guard plates 66, 68 to fit just slightly outside the outer surfaces of support plates 12, 14 as guard plates 66, 68 rotate as a unit about the axis of fastening joint 38. Although somewhat larger in dimension, guard plates 66, 68 have substantially the same shape as blade 40, except for a V-shaped notch with convex legs. The V-shaped notch is located to prevent guard plates 66, 68 from contacting the pivotal fastening joints 74, 76 of anchor arms 22, 24 when rotatable blade mechanism 20 is in a down position with handle 48 horizontal. With guard plates 66, 68 centered on blade 40 such that the straight edges of the guard plates 66, 68 are parallel to the straight edges of blade 40, a circular opening of diameter slightly larger than the diameter of spacers 54 and 58 is provided in guard plates 66, 68 at a location which allows guard plates 66, 68 to maintain the just-described relationship with plate 40 as the guard plates 66, 68 rotate about fastening joint 38 with blade 40. Guard plates 66, 68 are yieldingly held relative to blade 40 with coil spring 78 which is attached between handle 48 and guard plates 66, 68. One end of coil spring 78 is fastened to handle 48 with a screw 80 threaded into handle 48. The other end of coil spring 78 is hooked about screw 82, which is inserted through openings in guard plates 66, 68 and fastened with nut 84. Screw 82 passes through corresponding openings in guard plates 66, 68 located near the intersection of the two straight edges of the peripheral contour of guard plates 66, 68. Coil spring 78 is relaxed as long as no hose is being cut in hose cutter 10.

As shown in FIGS. 1 and 3, fastening joints 74 and 76 are located approximately vertically beneath the vertical legs of the corresponding U-shaped slots in support plates 12, 14 and near the vertical portion of angles 16, 18. Both fastening joints 74 and 76 are comprised of a thumb screw 86, which passes through one of the anchor arms 22 or 24, as appropriate, and through spacers 88 before being screwed into threaded openings in both support plates 12 and 14. Spacers 88 have length sufficient to hold the inner surfaces of anchor arms 22, 24 beyond the outer surfaces of guard plate 66.

Anchor arm 22 is located near the left edge of support plates 12, 14 as viewed from the outer side of support plate 12 and is pivotally attached to support plates 12, 14 at fastening joint 74 with thumb screw 86. Anchor arm 24 is located near the center of support plates 12, 14 and is attached to support plates 12, 14 at fastening joint 76 with thumb screw 86. Anchor arm 22, identical to anchor arm 24, has length extending from beneath fastening joint 74 to above fastening joint 38. Anchor arm 22 has width somewhat greater than the diameter of spacer 54 in fastening joint 38. Anchor arm 22 has a step-like notch cut into its upper portion such that with anchor arm 22 rotated to a vertical orientation, the step surface 90 contacts the lower surface of spacer 54 and forces the upper surface of spacer 56 against the upper surface 50 of the corresponding U-shaped slots in support plates 12, 14. Since anchor arm 22 rotates clockwise about fastening joint 74, the forward edge of surface 90 is broken in the shape of a short radius so that as anchor arm 22 rotates into place under spacer 54, the forward edge of surface 90 does not catch spacer 54 and prevent surface 90 from attaining a horizontal orientation. Rising from surface 90 at its rearward edge is a vertical extension 92 of anchor arm 22. Vertical extension 92 contacts spacer 54 at 90° from surface 90 when surface 90 has attained a horizontal orientation. Vertical extension 92 prevents anchor arm 22 from further rotating. Horizontal extension 94 extends perpendicularly away from vertical extension 92 and provides a short handle with which to manually rotate anchor arm 22.

It is to be understood that the anchoring function may be accomplished by means other than anchor arms 22, 24 and pivoted fastening joints 74 and 76. For example, a cradle member may swing under spacer 54 to lock it in place.

Corresponding circular openings of different diameters in support plates 12, 14 are provided to support various diameter hoses to be cut. Corresponding openings are located relative to each of the two anchor stations such that when rotatable blade mechanism 20 is in an up position, a hose may be inserted through any of the corresponding openings usable for the applicable anchor station. The corresponding openings are further located such that when the rotatable blade mechanism 20 is in the down position, blade 40 extends beneath the lower-most point of each of the usable openings for the applicable anchor station.

In the preferred embodiment, hose support openings of diameters 0.688, 1.062, and 0.500 inches are provided with respect to station A, the anchor station with fastening joint 38 fixed between surface 50 of the vertical legs of the corresponding U-shaped slots and surface 90 of anchor arm 22 (see FIGS. 1 and 2). The larger diameter openings 96 are centered on blade 40 as blade 40 rotates downward. Openings 96 are located a minimal material distance away from the U-shaped slots, that is, located to leave only sufficient material between the upper periphery of openings 96 and the U-shaped slots to prevent structural breakage. The next larger openings 98 are located toward anchor arm 22 a minimal material distance from openings 96 such that the lowermost point of both openings 96 and 98 lie along the same horizontal plane. The smallest openings 100 are located toward anchor arm 24 a minimal material distance from both the corresponding U-shaped slots and openings 96.

In a similar manner, corresponding openings of diameters 0.813 and 1.375 inches are located at station B, the anchor station where fastening joint 38 is fixed between surface 52 of the corresponding U-shaped slots and surface 90 of anchor arm 24 (see FIG. 3). The larger openings 102 are located such that blade 40 does not contact a hose supported by openings 102 until handle 48 has rotated from its rest position on one side of the vertical to a position on the other side of the vertical. Smaller openings 104 are located toward anchor arm 24 a minimal material distance from and somewhat below openings 102.

In operation, an uncut hose is inserted into corresponding support openings in support plates 12, 14. Nominally, the hose is of a diameter slightly smaller than the diameter of the appropriate corresponding support openings. Assuming a hose is inserted into openings 104 for anchor station B as shown in FIG. 2, rotatable blade mechanism 20 is moved along the corresponding U-shaped slots into the vertical legs near the center of support plates 12, 14. Anchor arm 24 is rotated clockwise into a vertical position so that surface 90 contacts spacer 54 and forces spacer 56 against upper edges 52 of the vertical legs of the corresponding U-shaped slots. With the hose positioned in openings 104 such that the desired cutting plane is directly beneath the cutting edge of blade 40, rotatable blade mechanism 20 is rotated clockwise and forced downward so that blade 40 cuttingly moves through the hose. During the rotatable cutting movement, when guard plates 66, 68 contact the hose, the rotational movement of the guard plates stops and coil spring 78 begins extending, forcing guard plates 66, 68 to press increasingly on the upper surface of the hose while the lower surface of openings 104 supports the hose. Upon completion of the cutting, when the two pieces of hose are moved in opposite directions away from hose cutter 10, guard plates 66, 68 are forced by coil spring 78 to snap downward into a centering position relative to blade 40.

In a similar manner, hose cutter 10 may use station A to cut an appropriate diameter hose.

Numerous characteristics and advantages of the invention have been set forth in the foregoing description, together with details of the structure and function of the invention. The disclosure, however, is illustrative only, and it is therefore to be understood that changes may be made in detail, especially in matters of shape, size, and arrangement, within the principle of the invention, to the full extent extended by the general meaning of the terms in which the appended claims are expressed.

What is claimed is:

1. Apparatus for cutting a hose, comprising:

(a) a blade;

(b) means for supporting said hose while said blade is cuttingly moved through said hose;

(c) means attached to said blade for moving said blade with respect to said hose support means; and (d) means for anchoring said blade moving means to said hose support means at a plurality of anchoring stations, said anchoring means allowing translation of said blade moving means from one station to another.

2. Apparatus for cutting a hose in accordance with claim 1 wherein said blade moving means includes means for pivotally attaching said blade at an off-center point on said blade to said hose support means and includes a longitudinally-extending handle attached to said blade, whereby said handle is a lever about the off-center point for pivotally forcing said blade in a cutting motion through said hose.

3. Apparatus for cutting a hose in accordance with claim 2 wherein said hose support means includes two support plates spaced-apart having a corresponding circular opening through each support plate at each anchoring station for said blade moving means, said openings having a diameter at one station different from the diameter of the openings at another station, whereby said blade can be moved at each anchoring station between said support plates to cut said hose, said hose being supported on either side of said blade by the openings in said support plates.

4. Apparatus for cutting a hose in accordance with claim 3 wherein said support plates have corresponding U-shaped slots for slideable passage of said pivotal attaching means, said U-shaped slots having two sets of leg slots and a set of base slots, and wherein said anchoring means includes two rotatable arms attached to said support plates having axes of rotation normal to said support plates, the axis of one arm located generally below one set of corresponding leg slots and the axis of the other arm located generally below the other set of corresponding leg slots, each said arm having a notch for engaging said pivotal attaching means, said notch of a particular arm locking said pivotal attaching means into the set of corresponding leg slots generally above the axis of said particular arm.

5. Apparatus for cutting a hose, comprising:

(a) two support plates connected together in a spaced-apart relationship;

(b) base means for holding said support plates in a vertically-upright orientation;

(c) a blade with attached handle for cutting said hose;

(d) means for anchoring said blade between said support plates at a plurality of anchoring locations including means for pivotally attaching said blade at an off-center point on said blade to said support plates at each anchoring location; and (e) means integral to said support plates for supporting hoses of different diameters at each anchoring location;

whereby at each anchoring location said blade may be rotated between said support plates about said pivotal attaching means to cut hose supported by said hose support means.

6. Apparatus for cutting a hose in accordance with claim 5 wherein said support plates have corresponding U-shaped slots for slideable passage of said pivotal attaching means, said U-shaped slots having two sets of leg slots and a set of base slots; wherein said blade anchoring means includes two rotatable arms having axes of rotation normal to said support plates, the axis of one arm located generally below one set of corresponding leg slots and the axis of the other arm located generally below the other set of corresponding leg slots, each said arm having a notch for engaging said pivotal attaching means and locking said pivotal attaching means into an appropriate set of corresponding leg slots.

7. Apparatus for cutting a hose in accordance with claim 6 wherein said hose supporting means includes a plurality of corresponding circular openings through each support plate at each anchoring location for said blade, said openings at one location having different diameters from each other and from the diameters of the openings at another location, whereby said hose to be cut is placed in a set of corresponding openings of slightly larger diameter than said hose and as said blade is moved between said support plates to cut said hose, said hose is supported on either side of said blade by the opening in said respective support plate.

8. Apparatus for cutting a hose in accordance with claims 4 or 7 further comprising means for guarding said blade including two guard plates for said blade, said guard plates attached in a spaced-apart relationship with one guard plate on either side of the spaced-apart support plates and rotatable independently from said blade about the axis of said pivotal attaching means, said guard plates yieldingly held relative to said blade by a spring attached in tension between said guard plates and said handle, whereby, as said blade moves cuttingly through said hose, said guard plates stop and press increasingly more against said hose, according to the tension in said extending spring.

9. A hose cutter, comprising:

(a) a blade with attached handle;

(b) two support plates connected together in a spaced-apart relationship, said blade rotatably attached at an off-center point with a pin to said support plates, said support plates having corresponding U-shaped slots for slideable passage of said pin, said U-shaped slots having two sets of leg slots and a set of base slots, each said leg slot having an upper end wall and side walls, said support plates having a plurality of corresponding circular openings with non-corresponding openings having different diameters, said corresponding openings for supporting said hose to be cut;

(b) two rotatable arms attached to said support plates having axes normal to said support plates, the axis of one arm located generally below one set of corresponding leg slots and the axis of the other arm located generally below the other set of corresponding leg slots, each said arm having a notch for engaging said pin against the upper end wall and side walls of the corresponding leg slots of the set generally above the axis of each said arm;

(c) two guard plates of larger but similar shape as said blade, said guard plates attached in a spaced-apart relationship with one guard plate on either side of the spaced-apart support plates and rotatable independently from said blade with axis of rotation about said pin, said guard plates yieldingly held relative to said blade by a spring attached in tension between said guard plates and said handle so as said blade moves cuttingly through said hose, said guard plates stop and press increasingly against said hose according to the tension in said extending spring; and (d) means attached to said support plates for holding said support plates in a vertically-upright orientation.

* * * * *